US007607587B2

(12) United States Patent
Fukuchi et al.

(10) Patent No.: US 7,607,587 B2
(45) Date of Patent: Oct. 27, 2009

(54) CARD DEVICE

(75) Inventors: Hiroaki Fukuchi, Sagamihara (JP); Wataru Kakinoki, Nagaokakyo (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 12/044,398

(22) Filed: Mar. 7, 2008

(65) Prior Publication Data

US 2008/0149740 A1 Jun. 26, 2008

Related U.S. Application Data

(63) Continuation of application No. PCT/JP2006/317232, filed on Aug. 31, 2006.

(30) Foreign Application Priority Data

Sep. 16, 2005 (JP) ..... 2005-269512

(51) Int. Cl.

| | |
|---|---|
| ***G06K 19/06*** | (2006.01) |
| ***G06K 7/06*** | (2006.01) |
| ***H05K 7/14*** | (2006.01) |
| ***H05K 7/18*** | (2006.01) |

(52) U.S. Cl. ..... 235/492; 235/441; 361/797

(58) Field of Classification Search ..... 235/380, 235/492, 441, 451; 361/797, 737; 439/630, 439/632, 946, 607.22–33, 151

See application file for complete search history.

(56) References Cited

U.S. PATENT DOCUMENTS

| | | | | |
|---|---|---|---|---|
| 4,565,922 | A * | 1/1986 | Anderson | 235/492 |
| 6,634,563 | B1 * | 10/2003 | Lippert | 235/492 |
| 6,824,066 | B2 * | 11/2004 | Weyant | 235/493 |
| 7,070,095 | B1 * | 7/2006 | Gandel et al. | 235/380 |
| 7,177,159 | B2 * | 2/2007 | Wang et al. | 361/797 |
| 2003/0053299 | A1 | 3/2003 | Kasuya et al. | |
| 2004/0235354 | A1 * | 11/2004 | Takahashi | 439/630 |

FOREIGN PATENT DOCUMENTS

| | | |
|---|---|---|
| JP | 64-72898 | 3/1989 |
| JP | 1-158172 | 11/1989 |
| JP | 2-11395 | 1/1990 |
| JP | 4-33583 | 3/1992 |
| JP | 7-323685 | 12/1995 |
| JP | 2003-091706 | 3/2003 |
| JP | 2003-108969 | 4/2003 |

OTHER PUBLICATIONS

International Search Report issued Sep. 26, 2006.
Written Opinion with English language translation.

* cited by examiner

*Primary Examiner*—Daniel Walsh
*Assistant Examiner*—Thien T Mai
(74) *Attorney, Agent, or Firm*—Ostrolenl Faber LLP

(57) ABSTRACT

A card device includes a card casing accommodating a circuit board. The card device is capable of being inserted into and pulled out from a card slot in an apparatus in which the card device is to be mounted. An anti-slipping member is anchored and exposed at a rear-end wall portion of a peripheral wall of the card casing for being held at least when the card device is inserted or pulled out. The rear-end wall portion is positioned at a rear end of the card device opposite to the end of the card device that is inserted into the card slot.

12 Claims, 6 Drawing Sheets

CARD DEVICE

CROSS-REFERENCE TO RELATED APPLICATIONS

This is a continuation under 35 U.S.C. § 111 (a) of PCT/JP2006/317232 filed Aug. 31, 2006, and claims priority of JP2005-269512 filed Sep. 16, 2005, incorporated by reference.

BACKGROUND

1. Technical Field

The present disclosure relates to a card device, such as an SD card and a PC card.

2. Background Art

FIG. 8*a* is a schematic perspective view of a card device. FIG. 8*b* is a schematic exploded view of the card device. The card device 40 includes a circuit board 41, a card casing 42 that accommodates the circuit board 41, and external connection means (a connector) 43, which will be described below.

The card casing 42 includes a front casing piece 44 that covers the front side of the circuit board 41 and a back casing piece 45 that covers the back side of the circuit board 41. The front casing piece 44 and the back casing piece 45 are assembled together to form the card casing 42. If the front casing piece 44 and the back casing piece 45 are both made of resin material, they are assembled together by, for example, the following process. That is, first, peripheral walls 46 and 47 provided on the front casing piece 44 and the back casing piece 45, respectively, are brought into contact with each other at the edges thereof. Then, the portions of the peripheral walls 46 and 47 that are in contact with each other are bonded to each other by, for example, ultrasonic welding so that the front casing piece 44 and the back casing piece 45 are integrated with each other. Thus, the card casing 42 is manufactured.

The external connection means 43 electrically connects electric circuits on the circuit board 41 to an external device. The external connection means 43 is disposed at an end of the card casing 42, and a connecting end face of the external connection means 43 is exposed at an end face of the card casing 42.

See BRANSON, "TECHNICAL INFORMATION Ultrasonic Welding" for background information on ultrasonic welding.

The card device 40 shown in FIG. 8*a* is capable of being inserted into and pulled out from a card slot formed in an apparatus like a personal computer as necessary. In the process of mounting the card device 40 into the apparatus like a personal computer through the card slot thereof, the card device 40 is, for example, inserted into the card slot while the card device 40 is held by fingers. In the process of removing the card device 40 from the apparatus like a personal computer through card slot thereof, the card device 40 is pulled out from the card slot while the card device 40 is held by fingers. Thus, the card device 40 is inserted or pulled out while the card device 40 is held by fingers.

The card casing 42 of the card device 40 is formed by, for example, molding a resin material. Therefore, the card casing 42 has smooth surfaces. Consequently, the fingers easily slip on the card casing surfaces when the card device 40 is inserted or pulled out, which causes a problem that the card device 40 is cumbersome to handle and can possibly be damaged.

SUMMARY

The disclosed card device has a structure to solve the above-described problem. That is, a card device includes a card casing accommodating a circuit board, and is capable of being inserted into and pulled out from a card slot in an apparatus in which the card device is to be mounted. An anti-slipping member is anchored at a rear-end wall portion of a peripheral wall of the card casing such that the anti-slipping member is exposed at a surface of the card device at which the card device is held at least when the card device is inserted or pulled out. The rear-end wall portion is positioned at a rear end of the card device, opposite to an insertion direction in which the card device is inserted into the card slot.

The anti-slipping member is provided at the rear-end wall portion of the peripheral wall of the card casing, the rear-end wall portion being positioned at the rear end of the card device, facing the rear direction opposite to the insertion direction in which the card device is inserted into the card slot. The anti-slipping member is disposed at a section of the card device at which the card device is held at least when the card device is inserted or pulled out. Therefore, when the card device is inserted into or pulled out from the card slot, fingers holding the card device do not easily slip on the surface of the card casing and the card device is easy to hold. As a result, the card device can be smoothly inserted into or pulled out from the card slot, so that the user-friendliness of the card device can be improved and the risk of damage can be reduced.

In addition, the anti-slipping member is formed as a component separate from the card casing. Therefore, the material, shape, etc., of the anti-slipping member can be designed without being limited by the material, shape, etc. of the card casing. Hence, the design freedom of the outer shape of the card device can be increased. In addition, the resistance to dropping shock and the like can be increased if the anti-slipping member is made of an elastic material.

Other features and advantages of the card device will become apparent from the following description of embodiments thereof which refers to the accompanying drawings.

DETAILED DESCRIPTION

Reference Numerals

Figure 1A:
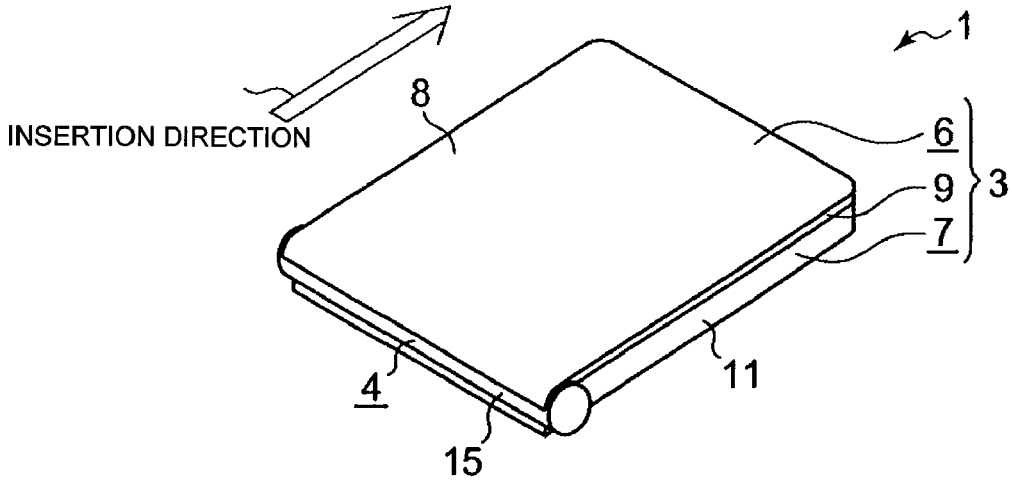
FIG. 1*a* is a schematic perspective view illustrating a card device according to a first embodiment.

1: card device
2: circuit board
3: card casing
4: anti-slipping member
6: front casing piece
7: back casing piece
9, 11: peripheral wall
12, 13: notch
16: support portion
17: internal latch portion
21: projection Embodiments of the card device will be described below with reference to the drawings.

Figure 1B:
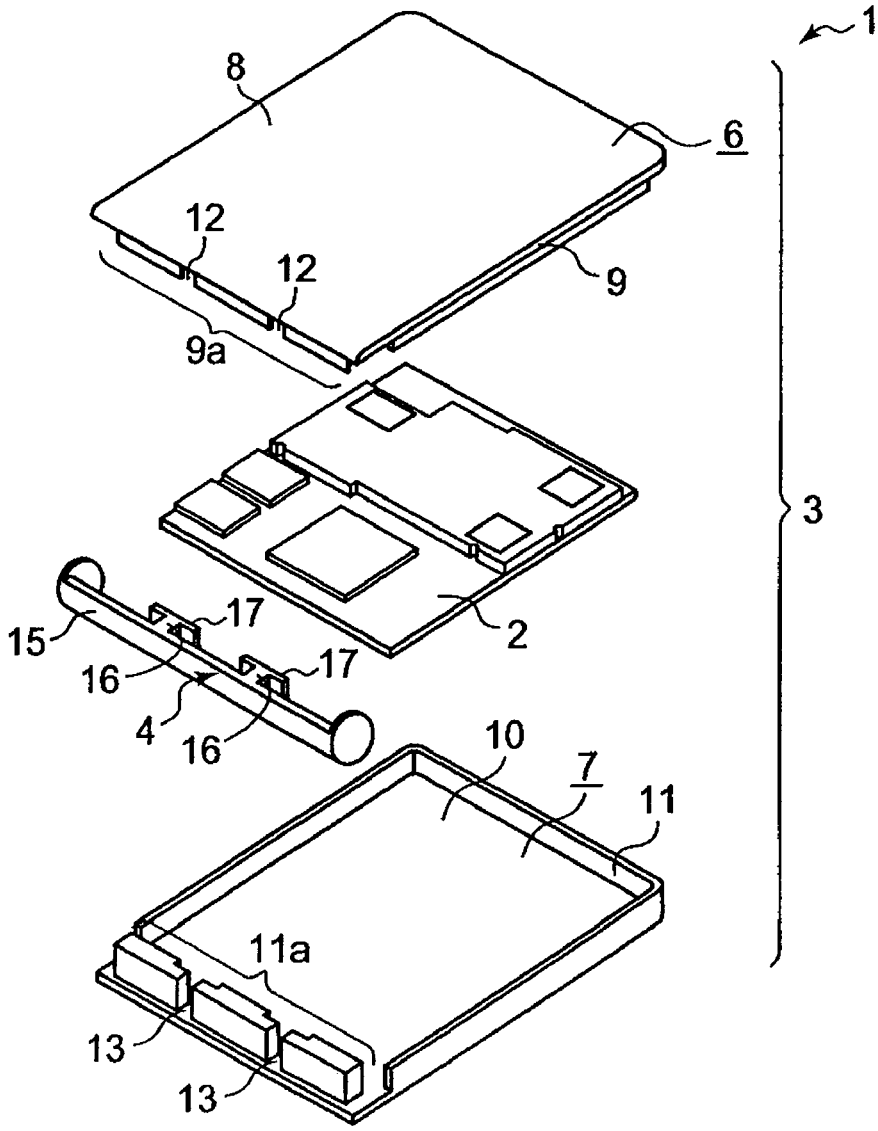
FIG. 1*b* is a schematic exploded view of the card device shown in FIG. 1*a*.

FIG. 1*a* is a schematic perspective view of a card device according to a first embodiment. FIG. 1*b* is a schematic exploded view of the card device according to the first embodiment. The card device 1 includes a circuit board 2, a card casing 3 that accommodates the circuit board 2, and an anti-slipping member 4 attached to the card casing 3. The card device 1 is capable of being inserted into and pulled out from a card slot formed in an apparatus like a personal computer in which the card device 1 is to be mounted. The card device 1 also includes external connection means (not shown) for electrically connecting electric circuits on the circuit board 2 to an external device. The external connection means may have various structures. In the first embodiment, the structure of the external connection means is not particularly limited. The external connection means in the card device 1 may include, for example, a connector or a connecting terminal and may have a structure corresponding to that of connection means provided in the apparatus to which the card device 1 is to be mounted. Explanations of the structure of the external connection means will be omitted here.

The card casing 3 includes a front casing piece 6 that covers the front side of the circuit board 2 and a back casing piece 7 that covers the back side of the circuit board 2. The front casing piece 6 has a flat front casing plate 8 that covers the front surface of the circuit board 2 and a peripheral wall 9 that stands upright from the casing plate 8. The back casing piece 7 has a flat back casing plate 10 that covers the back surface of the circuit board 2 and a peripheral wall 11 that stands upright from the casing plate 10. The peripheral walls 9 and 11 of the front casing piece 6 and the back casing piece 7, respectively, are brought into contact with each other at the upright edges thereof, and the portions that are in contact with each other are bonded to each other by ultrasonic welding to form the card casing 3. Accordingly, in the first embodiment, the front casing piece 6 and the back casing piece 7 are made of a material suitable for ultrasonic welding (for example, resin material such as polycarbonate).

In the first embodiment, the anti-slipping member 4 is provided on a rear-end wall portion of a peripheral wall of the card casing 3. The rear-end wall portion is at a rear end of the card casing 3 in an insertion direction in which the card device 1 is inserted into a card slot in an apparatus in which the card device 1 is to be mounted. The anti-slipping member 4 is anchored by the following structure. That is, the peripheral walls 9 and 11 of the front casing piece 6 and the back casing piece 7, respectively, which form the card casing 3 respectively have rear-end-face-forming wall portions 9*a* and 11*a* that define the rear-end wall portion of the card casing 3 at the rear end in the insertion direction. The rear-end-face-forming wall portion 9*a* of the front casing piece 6 has a plurality of notches 12 extending from the upright edge of the rear-end-face-forming wall portion 9*a* toward the base thereof (in other words, upward from the bottom edge in FIG. 1*b*). The rear-end-face-forming wall portion 11*a* of the back casing piece 7 has a plurality of notches 13 extending from the upright edge of the rear-end-face-forming wall portion 11*a* toward the base thereof (in other words, downward from the top edge in FIG. 1*b*). The notches 13 are formed at positions corresponding to the positions where the notches 12 are formed in the front casing piece 6.

The anti-slipping member 4 has a main body 15 exposed so as to cover the rear-end wall portion of the peripheral wall of the card casing 3, a plurality of support portions 16 extending from the main body 15 toward the inside of the card casing 3, and internal latch portions 17 disposed in the casing at the distal ends of the respective support portions 16.

Figure 2A:
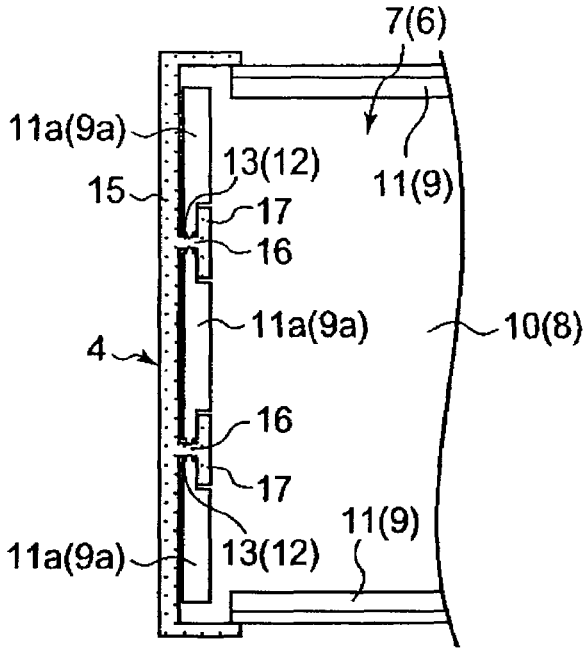
FIG. 2*a* is a diagram illustrating the structure for anchoring an anti-slipping member in the card device according to the first embodiment.

In the first embodiment, the support portions 16 are provided at positions corresponding to the positions where the notches 12 and 13 are formed in the rear-end-face-forming wall portions 9*a* and 11*a*, respectively, in the card casing 3. As shown in FIG. 2*a*, which is a plan view, the support portions 16 can be placed in the respective notches 13 (12). The internal latch portions 17 are provided at the distal ends of the respective support portions 16 that are positioned inside the card casing when the support portions 16 are placed in the notches 12 and 13. The internal latch portions 17 engage with inner surfaces of the rear-end-face-forming wall portions 9*a* and 11*a* that face the inside of the card casing 3, thereby preventing the anti-slipping member 4 from being detached. In the first embodiment, the internal latch portions 17 are tab-shaped (T-shaped) and extend along the inner surfaces of the rear-end-face-forming wall portions 9*a* and 11*a* from parts of the support portions 16 that are disposed inside the casing.

Figure 2B:
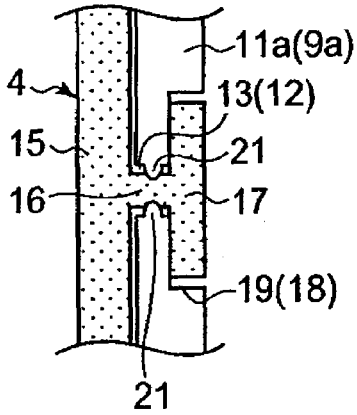
FIG. 2*b* is a partial enlarged view of FIG. 2*a*.

In the first embodiment, the rear-end-face-forming wall portions 9*a* and 11*a* have recesses 18 and 19, respectively, in the inner surfaces thereof for receiving the internal latch portions 17 at positions corresponding to the positions where the notches 12 and 13 are formed (see FIG. 2*b*, which is an enlarged view). The internal latch portions 17 are placed in the recesses 18 and 19 formed in the inner surfaces of the rear-end-face-forming wall portions 9*a* and 11*a*, respectively, and are engaged with the inner surfaces of the recesses 18 and 19. The size of the internal latch portions 17 and the size of the recesses 18 and 19 are preferably determined in association with each other such that the internal latch portions 17 do not project from the inner surfaces of the rear-end-face-forming wall portions 9*a* and 11*a* toward the inside of the card casing in the state in which the internal latch portions 17 are placed in the recesses 18 and 19 and are engaged with the inner surfaces of the recesses. Therefore, the internal latch portions 17 do not project from the inner surfaces of the rear-end-face-forming wall portions 9*a* and 11*a* toward the inside of the card casing. Thus, the inner space of the card casing 3 is prevented from being reduced by the internal latch portions 17.

In the first embodiment, the front casing piece 6 and the back casing piece 7 are bonded together by ultrasonic welding to form the card casing 3 while the anti-slipping member 4 is assembled thereto. Therefore, the entire body of the anti-slipping member 4 is formed by an elastic material, such as elastomer, which is not melted or deformed (welded) due to ultrasonic waves when the front casing piece 6 and the back casing piece 7 are bonded together by ultrasonic welding.

In addition, the thickness of the main body 15 of the anti-slipping member 4 is preferably set to be smaller than the thickness of the peripheral wall of the card casing 3 including the rear-end-face-forming wall portions 9*a* and 11*a* (that is, portions to be bonded together by ultrasonic welding). Accordingly, even though the anti-slipping member 4 is made of an elastic material, ultrasonic vibration applied to the front casing piece 6 and the back casing piece 7 is prevented from being absorbed by the main body 15 of the anti-slipping member 4 in the process of bonding the front casing piece 6 and the back casing piece 7 together by ultrasonic welding. Therefore, the portions to be bonded together by ultrasonic welding are vibrated by ultrasonic vibration while being in uniform contact with each other, whereby the front casing piece 6 and the back casing piece 7 can be evenly bonded together by ultrasonic welding.

In addition, in the first embodiment, the rear-end wall portion of the card casing 3 has projections 21 that are formed so as to project from wall surfaces of the notches 12 and 13 and bite into surfaces of the support portions 16 in the notches 12 and 13 (see FIG. 2*b*). The projections 21 are provided on either side of each of the support portions 16 in the notches 12 and 13. The support portions 16 are clamped between the projections 21 and are thereby fixed in the notches 12 and 13. The projections 21 are formed in the process of bonding the front casing piece 6 and the back casing piece 7 together as described below.

Figure 3A:
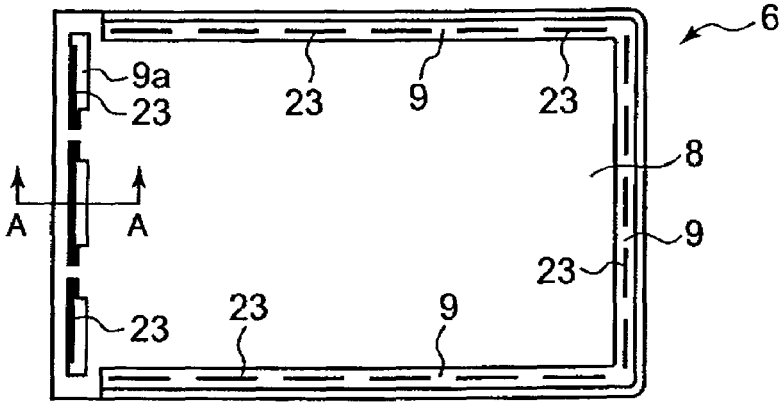
FIG. 3*a* is a diagram illustrating a front casing piece included in the card device according to the first embodiment in the state before assembly.
Figure 3B:
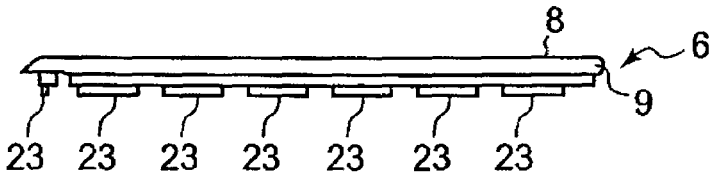
FIG. 3*b* is a side view of the front casing piece shown in FIG. 3*a*.
Figure 3C:
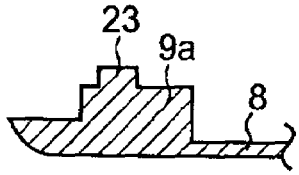
FIG. 3*c* is a sectional view of FIG. 3*a* taken along line A-A.

First, for example, the front casing piece 6, the back casing piece 7, the anti-slipping member 4, and the circuit board 2 are prepared as shown in FIG. 1*b*, which is an exploded view. FIG. 3*a* is a schematic plan view of the front casing piece 6 before being bonded to the back casing piece 7 viewed from the bottom in FIG. 1*b*. FIG. 3*b* is a schematic side view of the front casing piece 6 shown in FIG. 3*a*. FIG. 3*c* is a schematic sectional view of FIG. 3*a* taken along line A-A. As shown in FIGS. 3*a* to 3*c*, in the state before bonding, projecting portions 23 that are thinner than the peripheral wall 9 are formed on the end face of the peripheral wall 9 at the upright edge of the peripheral wall 9 in the front casing piece 6. The projecting portions 23 are arranged with intervals therebetween along the peripheral wall 9 in a central area of the end face spaced from the sides thereof.

After the front casing piece 6, the back casing piece 7, the anti-slipping member 4, and the circuit board 2 are prepared, the support portions 16 of the anti-slipping member 4 are placed in the respective notches 13 in the rear-end-face-forming wall portion 11*a* of one of the casing piece 6 and the back casing piece 7 (for simplicity, the back casing piece 7 is chosen here). The internal latch portions 17 of the anti-slipping member 4 are disposed to be engaged the inner surface of the rear-end-face-forming wall portion 11*a* facing the inside of the card casing (the inner surfaces of the recesses 19). The circuit board 2 is placed in the back casing piece 7.

Then, the back casing piece 7 and the front casing piece 6 are positioned with respect to each other. More specifically, the edge of the peripheral wall 11 of the back casing piece 7 and the edge of the peripheral wall 9 of the front casing piece 6 are positioned with respect to each other. In addition, the notches 12 in the rear-end-face-forming wall portion 9*a* of the front casing piece 6 are positioned with respect to the respective notches 13 in the rear-end-face-forming wall portion 11*a* of the back casing piece 7. Thus, the back casing piece 7 and the front casing piece 6 are assembled together such that they are positioned with respect to each other. The projecting portions 23 are formed at the edge of the peripheral wall 9 of the front casing piece 6. Therefore, when the front casing piece 6 and the back casing piece 7 are assembled together, the end faces of the projecting portions 23 on the peripheral wall 9 of the front casing piece 6 come into contact with the end face of the peripheral wall 11 of the back casing piece 7.

After the front casing piece 6 and the back casing piece 7 are assembled together, the front casing piece 6 and the back casing piece 7 are bonded together by ultrasonic welding. More specifically, a pressing force is applied in the thickness direction of the card casing to the front casing piece 6 and the back casing piece 7 that are combined together, so that the front casing piece 6 and the back casing piece 7 are pressed against each other. In this state, ultrasonic waves are applied to the front casing piece 6 and the back casing piece 7. Consequently, the projecting portions 23 on the front casing piece 6 and the end face of the peripheral wall 11 of the back casing piece 7 that are in contact with each other vibrate and are rubbed against each other, so that heat is generated. As a result, the projecting portions 23 and the end face of the peripheral wall 11 are melted and bonded together. The ultrasonic welding conditions, such as ultrasonic-wave application time, are set such that the projecting portions 23 can be almost completely melted.

Figure 4A:
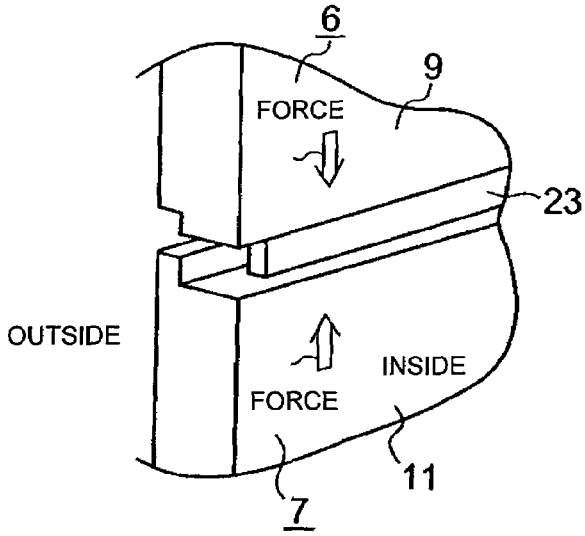
FIG. 4*a* is a diagram illustrating, together with FIG. 4*b*, an example of a method for bonding the front casing piece and a back casing piece together by ultrasonic welding.
Figure 4B:
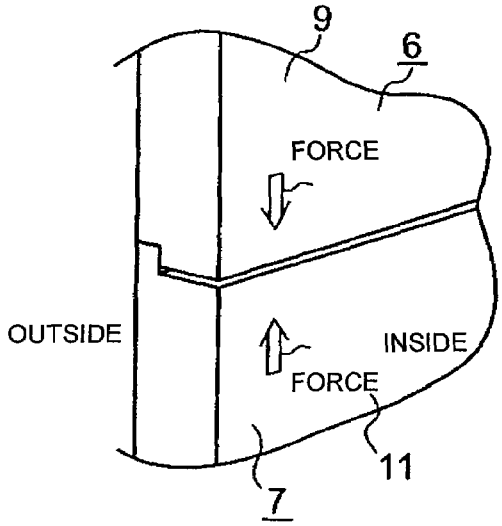
FIG. 4*b* is a diagram illustrating, together with FIG. 4*a*, an example of a method for bonding the front casing piece and the back casing piece together by ultrasonic welding.

During the application of the ultrasonic waves, the front casing piece 6 and the back casing piece 7 receive forces in directions such that they are pressed against each other, as in a model diagram shown in FIG. 4*a*. Therefore, a molten material obtained as a result of melting the front casing piece 6 and the back casing piece 7 by applying the ultrasonic waves is spread between the end faces of the peripheral walls 9 and 11 of the front casing piece 6 and the back casing piece 7, respectively, by the pressing forces. If the molten material protrudes from the surfaces of the peripheral walls 9 and 11, the appearance and the like will be degraded. Therefore, the volumes and positions of the projecting portions 23 are usually determined such that the molten material obtained by melting the projecting portions 23 does not protrude from the wall surfaces of the peripheral walls 9 and 11, as in a model diagram shown in FIG. 4*b*.

Figure 5A:
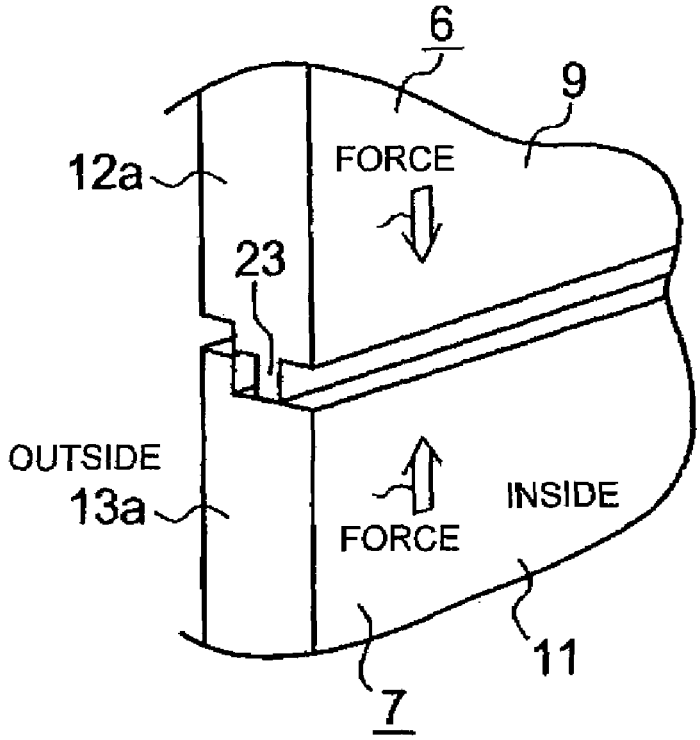
FIG. 5*a* is a diagram illustrating, together with FIG. 5*b*, an example of a method for forming a projection that projects into a notch from a notch surface toward a support portion of the anti-slipping member.
Figure 5B:
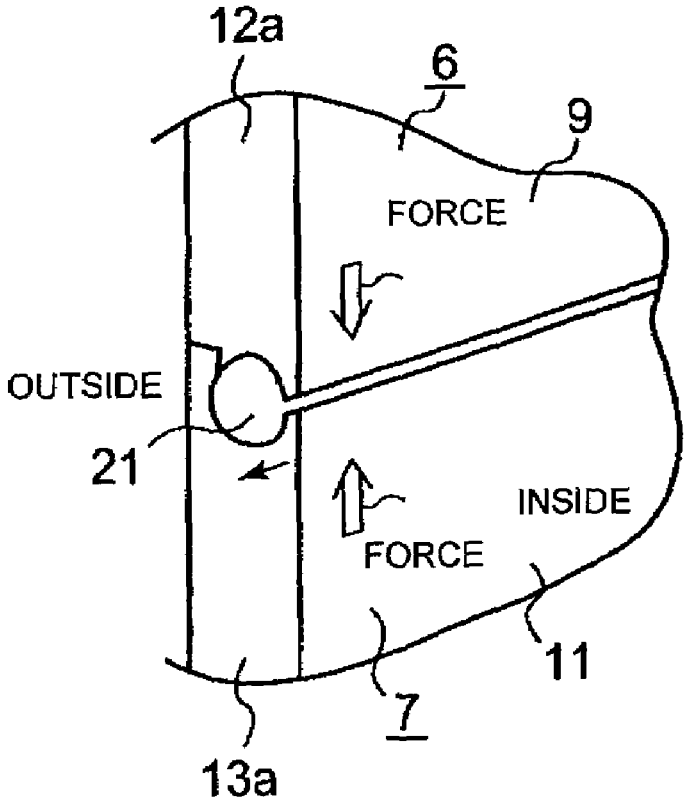
FIG. 5*b* is a diagram illustrating, together with FIG. 5*a*, an example of a method for forming the projection that projects into the notch from the notch surface toward the support portion of the anti-slipping member.

In contrast, in the first embodiment, the volumes and positions of the projecting portions 23 are determined such that the molten material obtained as a result of melting the projecting portions 23 by applying the ultrasonic waves partially protrudes from notch surfaces 12*a* and 13*a*, as in a model diagram shown in FIG. 5*b*. For example, as in a model diagram shown in FIG. 5*a*, the projecting portions 23 are formed so as to extend to the notch surfaces 12*a* and 13*a*. Thus, in the first embodiment, the molten material obtained as a result of melting the projecting portions 23 on the peripheral wall 9 by applying the ultrasonic waves partially protrudes into the notches 12 and 13 from between the peripheral walls 9 and 11. The molten material that protrudes into the notches 12 and 13 flows into the space surrounded by the notch surfaces 12*a* and 13*a* and the corresponding support portion 16, and projects into the notches 12 and 13 from the notch surfaces 12*a* and 13*a* while pushing the surface of the support portion 16 made of an elastic material and elastically deforming the support portion 16. The projections 21 are formed by curing the molten material in this state.

Thus, the projections 21 can be easily obtained by forming the projections 21 in the process of bonding the front casing piece 6 and the back casing piece 7 together. In addition, in the first embodiment, the projections 21 are formed after the support portions 16 of the anti-slipping member 4 are placed in the notches 12 and 13 formed in the peripheral walls 9 and 11 of the front casing piece 6 and the back casing piece 7, respectively, and the support portions 16 are fixed by the projections 21 in the notches 12 and 13. Therefore, in the process of placing the support portions 16 of the anti-slipping member 4 in the notches 12 and 13, the support portions 16 can be smoothly placed in the notches 12 and 13 without being blocked by the projections 21. In addition, the support portions 16 can be strongly fixed by the projections 21 in the notches 12 and 13.

In the first embodiment, the anti-slipping member 4 is anchored at the rear-end wall portion of the peripheral wall of the card casing 3. The rear-end wall portion is at the rear end of the card casing 3, at the end opposite to the insertion direction in which the card device 1 is inserted into the card slot in the apparatus in which the card device 1 is to be mounted. Therefore, when the card device 1 is inserted into or pulled out from the card slot in the apparatus in which the card device 1 is to be mounted, the fingers holding the card device 1 do not easily slip on the surfaces of the card casing 3 and the card device 1 is easy to hold. Therefore, the card device 1 can be smoothly inserted into or pulled out from the card slot.

In addition, in the first embodiment, the anti-slipping member 4 is made of an elastic material. Therefore, not only can the card device 1 be easily held, but the card device 1 has an improved, smooth feel when it is touched.

In addition, in the first embodiment, the notches 12 and 13 are formed in the rear-end-face-forming wall portions of the card casing 3. The anti-slipping member 4 is anchored by placing the support portions 16 in the notches 12 and 13 and engaging the internal latch portions 17 with the inner surfaces of the rear-end-face-forming wall portions 9*a* and 11*a* facing the inside of the card casing 3. Thus, the anti-slipping member 4 can be easily anchored at the rear-end wall portion of the peripheral wall 9 of the card casing 3 using a simple structure.

In addition, in the first embodiment, the front casing piece 6 and the back casing piece 7 are both made of a resin material, and the front casing piece 6 and the back casing piece 7 are bonded together by ultrasonic welding. In addition, the anti-slipping member 4 is made of a material that is not welded by ultrasonic waves when the ultrasonic waves are applied to bond the front casing piece 6 and the back casing piece 7 together. This structure allows the front casing piece 6 and the back casing piece 7 to be bonded together by ultrasonic welding without causing the anti-slipping member 4 to be welded (melted and deformed) in the state in which the front casing piece 6, the back casing piece 7, and the anti-slipping member 4 are assembled together. In other words, the anti-slipping member 4 can be assembled to the card casing 3 in the process of bonding the front casing piece 6 and the back casing piece 7 of the card casing 3 together. Therefore, even though the anti-slipping member 4 is attached to the card casing 3, the assembly process of the card device 1 is prevented from becoming complex.

In addition, the projections 21 are formed on the wall surfaces of the notches 12 and 13 so as to project toward the support portions 16 of the anti-slipping member 4 and press the surfaces of the support portions 16. Therefore, the support portions 16 can be fixed in the notches 12 and 13 and the anti-slipping member 4 can be strongly attached to the card casing 3.

A second embodiment will now be described. In the second embodiment, components similar to those of the first embodiment are denoted by the same reference numerals, and explanations thereof are omitted to avoid redundancy.

Figure 6:
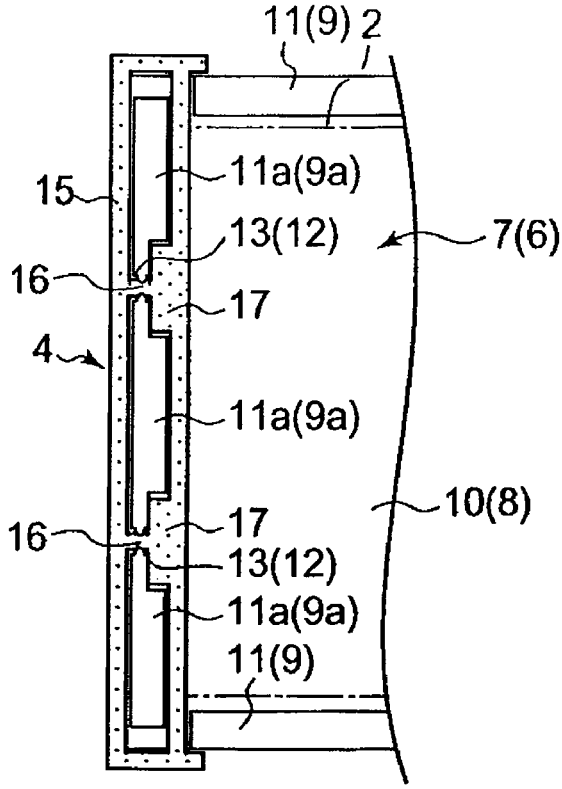
FIG. 6 is a diagram illustrating a second embodiment.

In the second embodiment, as shown in FIG. 6, which is a plan view, an anti-slipping member 4 includes a main body 15, a plurality of support portions 16 that project from the main body 15, and an internal latch portion 17 having the following structure. That is, the internal latch portion 17 functions as a connecting member that extends along the inner surfaces of the rear-end-face-forming wall portions 9*a* and 11*a* of the card casing 3 so as to connect the distal ends of the support portions 16 that are positioned inside the card casing.

In addition, in the second embodiment, the internal latch portion 17 is positioned closer to the inside of the card casing 3 than the rear-end-face-forming wall portions 9*a* and 11*a*, and an inner surface of the internal latch portion 17 that faces the inside of the card casing is flat. The inner surface of the internal latch portion 17 can function as a flat face portion for positioning and fixing the circuit board by coming into contact with the end face of the circuit board 2 accommodated in the card casing 3 and fixing the position where the circuit board 2 is arranged.

Other structures of the card device according to the second embodiment are similar to those of the first embodiment.

In the second embodiment, the flat face portion for positioning and fixing the circuit board is formed on a part of the anti-slipping member 4 that is disposed inside the card casing. Therefore, the following effects can be obtained. That is, the size of the card casing 3 varies due to the processing accuracy thereof. If the size of the card casing 3 is larger than the designed size, the circuit board 2 easily rattles in the card casing 3. In comparison, according to the second embodiment, the anti-slipping member 4 is made of an elastic material, and the flat face portion for positioning and fixing the circuit board is formed on a part of the anti-slipping member 4 that is disposed inside the card casing. Therefore, for example, the anti-slipping member 4 may be formed such that the circuit board 2 is fitted in the card casing 3 while the end face of the circuit board 2 pushes the flat face portion of the anti-slipping member 4 so as to elastically deform the flat face portion. In such a case, an elastic pressing force is applied from the flat face portion of the anti-slipping member 4 to the circuit board 2. The elastic pressing force serves to fix the circuit board 2 in the card casing 3 such that the end face of the circuit board 2 at the leading end thereof in the insertion direction is retained by an inner wall of the card casing 3 at the leading end thereof in the insertion direction. In addition, if, for example, the variation in the size of the card casing 3 is within an allowable range, the amount of elastic deformation of the flat face portion of the anti-slipping member 4 pressed by the circuit board 2 simply varies, and the circuit board 2 can be positioned and fixed to the card casing 3 without rattling. In other words, the circuit board 2 can be reliably fixed to the card casing 3 using a simple structure.

The present invention is not limited to the first and second embodiments, and various embodiments are possible. For example, although the anti-slipping member 4 is made of an elastic material in the first and second embodiments, the material of the anti-slipping member 4 is not limited to elastic materials as long as the material is not welded by ultrasonic waves when the ultrasonic waves are applied to bond the front casing piece 6 and the back casing piece 7 together.

Figure 7:
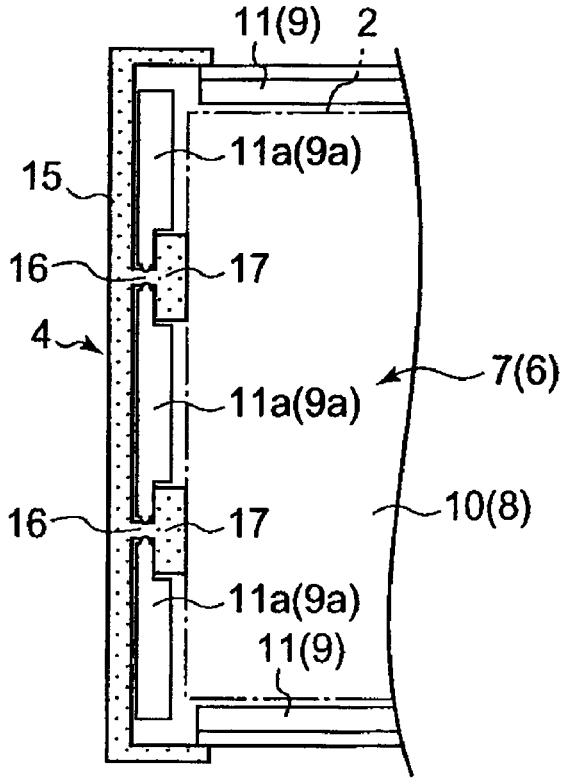
FIG. 7 is a diagram illustrating a third embodiment.
Figure 8A:
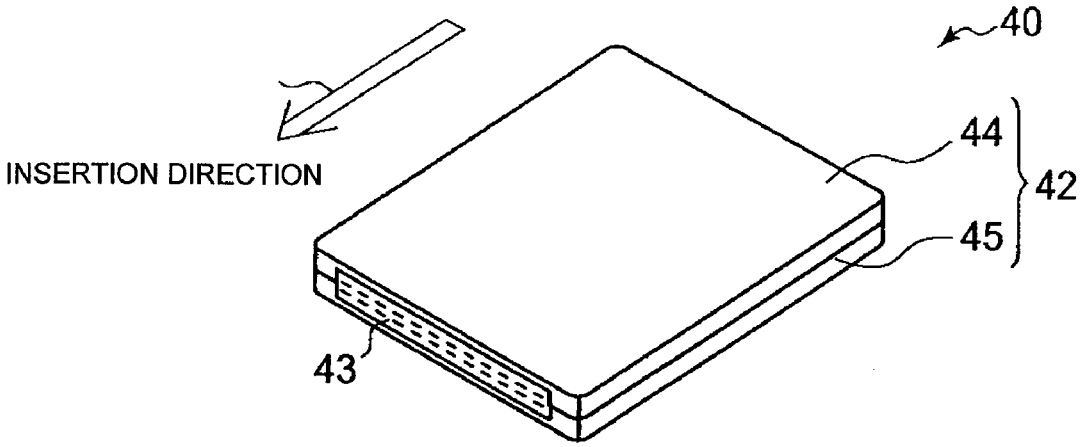
FIG. 8a PRIOR ART
FIG. 8*a* is a perspective view illustrating the structure of a known card device.
Figure 8B:
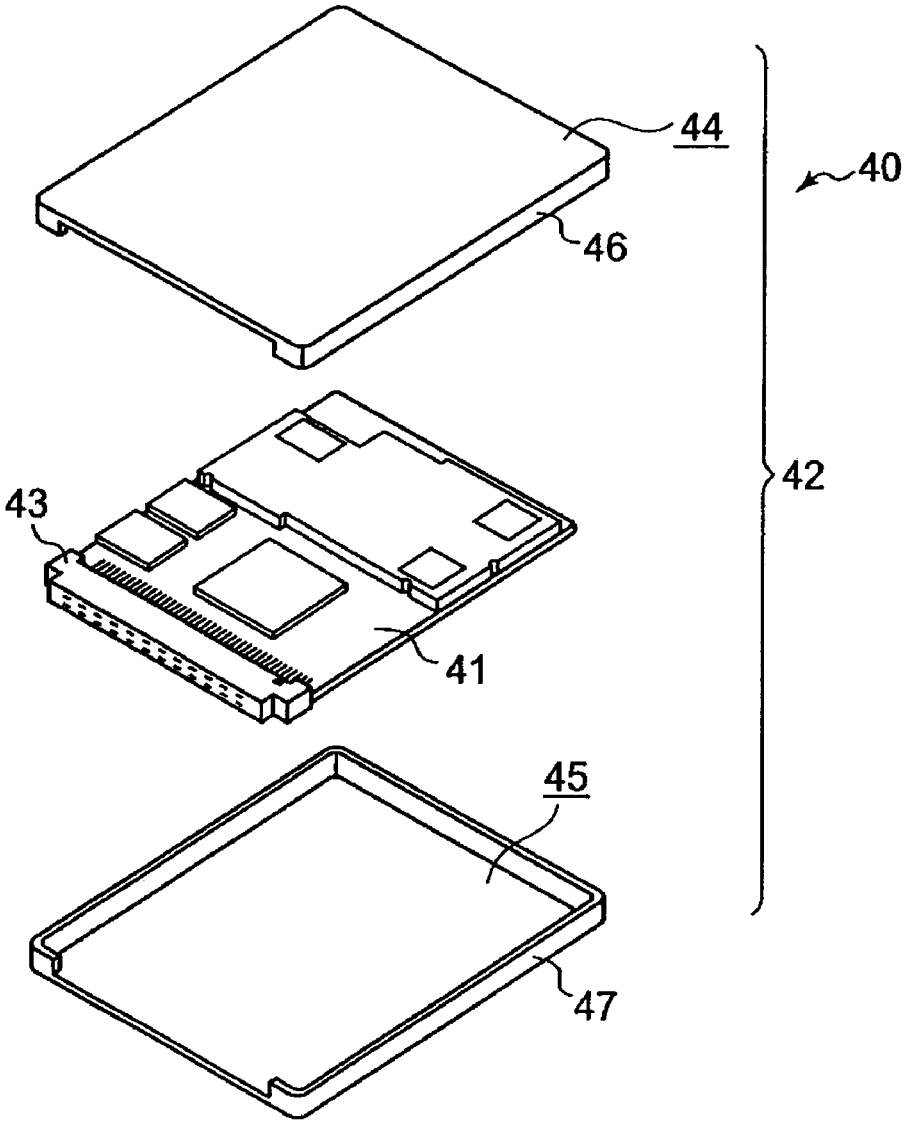
FIG. 8b PRIOR ART
FIG. 8*b* is a schematic exploded view of the card device shown in FIG. 8*a*.

In addition, in the first embodiment, the internal latch portions 17 of the anti-slipping member 4 do not project from the rear-end-face-forming wall portions 9*a* and 11*a* of the card casing 3 toward the inside of the card casing. However, as shown in FIG. 7, which is a plan view, the internal latch portions 17 of the anti-slipping member 4 may project from the rear-end-face-forming wall portions 9*a* and 11*a* of the card casing 3 toward the inside of the card casing. In this case, inner surfaces of the internal latch portions 17 facing the inside of the casing are formed as, for example, flat surfaces, and the inner surfaces of the internal latch portions 17 function as flat face portions for positioning and fixing the circuit board by coming into contact with the end face of the circuit board 2 accommodated in the card casing 3 and fixing the position where the circuit board 2 is arranged.

In addition, in each of the first and second embodiments, the peripheral walls 9 and 11 are respectively formed on the front casing piece 6 and the back casing piece 7. However, only one of the front casing piece 6 and the back casing piece 7 may be provided with a peripheral wall while the other has a flat plate shape.

In addition, in each of the first and second embodiments, the projections 21 are formed so as to project into the notches 12 and 13 from the notch surfaces 12*a* and 13*a* and bite into the surfaces of the support portions 16 of the anti-slipping member 4. However, the projections 21 may also be omitted if the anti-slipping member 4 can be attached to the card casing 3 in a desired manner without the projections 21.

In addition, in each of the first and second embodiments, each of the rear-end-face-forming wall portions 9*a* and 11*a* of the card casing 3 has a plurality of notches 12 and 13, and the anti-slipping member 4 has a plurality of support portions 16. However, the rear-end-face-forming wall portions 9*a* and 11*a* of the card casing 3 may respectively have a single notch 12 and a single notch 13, and the anti-slipping member 4 may have a single 16. Thus, the numbers of the notches 12 and 13 and the support portions support portion 16 of the anti-slipping member 4 can be suitably determined and are not particularly limited.

In addition, in each of the first and second embodiments, the front casing piece 6 and the back casing piece 7 are bonded together by ultrasonic welding. However, the front casing piece 6 and the back casing piece 7 may also be bonded together using a bonding technology other than ultrasonic welding.

The present invention is suitable for card devices, such as SD cards and PC cards, which are handled by fingers or the like.

Although particular embodiments have been described, many other variations and modifications and other uses will become apparent to those skilled in the art. Therefore, the present invention is not limited by the specific disclosure herein.

What is claimed is:

1. A card device for accommodating a circuit board, wherein the card device is configured to be inserted into and pulled out from a card slot by a user in an apparatus in which the card device is to be mounted, the card device comprising:

a card casing having a rear-end peripheral wall, and a front-end peripheral wall positioned on an opposite side of the card casing from the rear-end peripheral wall and facing forward in an insertion direction of the card device; and an anti-slipping member anchored and exposed at the rear-end peripheral wall of the card casing and configured to be held by the user at least when the card device is inserted or pulled out of the card slot, wherein the card casing includes a front casing piece positioned and configured to cover a front side of the circuit board and a back casing piece positioned and configured to cover a back side of the circuit board, wherein at least one of the front casing piece and the back casing piece of the card casing has a rear-end-face-forming wall portion that stands upright from a flat casing surface covering the circuit board and that defines the rear-end-face-forming wall portion of the card casing, the rear-end-face-forming wall portion having at least one notch extending from an upright edge of the rear-end-face-forming wall portion toward a base thereof, wherein the anti-slipping member includes at least one support portion that extends into the card casing from an outside of the card casing through the at least one notch in the rear-end-face-forming wall portion and an internal latch portion positioned on a part of the at least one support portion that is positioned inside the card casing, the internal latch portion being engaged with an inner surface of the rear-end-face-forming wall portion that faces the inside of the card casing so as to secure the anti-slipping member, wherein the front casing piece and the back casing piece are assembled together with the at least one support portion of the anti-slipping member being placed in the at least one notch and the internal latch portion being engaged with the inner surface of the rear-end-face-forming wall portion so that the anti-slipping member is anchored at the rear-end peripheral wall of the card casing, and wherein the upright edge of the rear-end-face-forming wall portion is in contact with the front casing piece and the back casing piece assembled thereto at a contact position, the front casing piece and the back casing piece being bonded together at the contact position.

2. The card device according to claim 1, wherein the anti-slipping member comprises an elastic material.

3. The card device according to claim 1, wherein the front casing piece and the back casing piece both comprise a resin material for being bondable together by ultrasonic welding, and wherein the anti-slipping member comprises a material that resists welding by ultrasonic waves when the ultrasonic waves are applied to bond together the front casing piece and the back casing piece.

4. The card device according to claim 3, wherein the anti-slipping member comprises an elastic material.

5. The card device according to claim 3, wherein a part of a bonding portion of the front casing piece and of the back casing piece, to be melted by the applied ultrasonic waves to bond the front casing piece and the back casing piece, is positioned and sized so as to flow into the at least one notch toward the at least one support portion of the anti-slipping member and to be cured to form a projection that projects from a wall surface of the at least one notch toward the at least one support portion so as to press a surface of the at least one support portion.

6. The card device according to claim 1, wherein the internal latch portion of the anti-slipping member is T-shaped and projects along the inner surface of the rear-end-face-forming wall portion of the card casing from the part of the at least one support portion that is positioned inside the card casing.

7. The card device according to claim 1, wherein a plurality of notches are formed in the rear-end-face-forming wall portion of the card casing, and wherein the anti-slipping member has a plurality of support portions corresponding to the plurality of notches in the rear-end-face-forming wall portion, the plurality of support portions having distal ends which are positioned inside the card casing and which are connected by a common connecting member extending along the inner surface of the rear-end-face-forming wall portion of the card casing, the connecting member serving as an internal latch portion for each support portion of the plurality of support portions.

8. The card device according to claim 1, wherein the anti-slipping member comprises an elastic material and has a flat face portion for positioning and fixing the circuit board formed on a part of the anti-slipping member that is positioned inside the card casing, the flat face portion being in contact with an end face of the circuit board accommodated in the card casing and fixing a position where the circuit board is arranged.

9. A method of assembling a card device for accommodating a circuit board, wherein the card device is configured to be inserted into and pulled out from a card slot in an apparatus in which the card device is to be mounted, the card device comprising a card casing and anti-slipping member anchored and exposed at a rear-end peripheral wall portion of the card casing for being held by a user at least when the card device is inserted or pulled out, the rear-end wall peripheral portion being positioned at a rear end of the card device which is opposite to an insertion direction in which the card device is inserted into the card slot;

wherein the card casing includes a front casing piece that covers a front side of the circuit board and a back casing piece that covers a back side of the circuit board, wherein at least one of the front casing piece and the back casing piece of the card casing has a rear-end-face-forming wall portion that stands upright from a flat casing surface covering the circuit board and that defines the rear-end peripheral wall portion of the card casing, the rear-end-face-forming wall portion having at least one notch extending from an upright edge of the rear-end-face-forming wall portion toward a base thereof, wherein the anti-slipping member includes at least one support portion that extends into the card casing from the outside of the card casing through the at least one notch in the rear-end- face-forming wall portion and an internal latch portion provided on a part of the at least one support portion that is disposed inside the card casing, the internal latch portion being engaged with an inner surface of the rear-end-face-forming wall portion that faces the inside of the card casing so as to prevent the anti-slipping member from being detached, said method comprising the steps of:

assembling the front casing piece and the back casing piece together while the at least one support portion of the anti-slipping member is disposed in the at least one notch and the internal latch portion is engaged with the inner surface of the rear-end-face-forming wall portion so that the anti-slipping member is anchored at the rear-end peripheral wall portion of the peripheral wall of the card casing, placing the upright edge of the rear-end-face-forming wall portion in contact with the casing piece assembled thereto at a contact position; and bonding together the front casing piece and the back casing piece by ultrasonic welding at the contact position;

wherein the front casing piece and the back casing piece are both made of a resin material, wherein the anti-slipping member is formed of a material that is not welded by ultrasonic waves when the ultrasonic waves are applied to bond the front casing piece and the back casing piece together; and providing a part of a bonding portion of the front casing piece and the back casing piece to be melted by the ultrasonic waves applied to bond the front casing piece and the back casing piece;

melting said bonding portion part by said ultrasonic waves, the bonding portion part being disposed and sized so that the resin material flows into the at least one notch toward the at least one support portion of the anti-slipping member and is cured there to form a projection that projects from a wall surface of the at least one notch toward the at least one support portion so as to press a surface of the at least one support portion.

10. The method according to claim 9, wherein the anti-slipping member comprises an elastic material.

11. A card device comprising a circuit board and a card casing accommodating the circuit board, wherein the card device is configured to be inserted into and pulled out from a card slot in an apparatus in which the card device is to be mounted, and wherein an anti-slipping member is anchored at a rear-end wall portion of a peripheral wall of the card casing in a section of the card device that can be held in a state in which the card device is inserted in the card slot, the anti-slipping member being anchored such that the anti-slipping member is exposed at a surface of a section of the card device at which the card device is held when the card device is inserted or pulled out, the rear-end wall portion being positioned at a rear end of the card device in an insertion direction in which the card device is inserted into the card slot, the card casing including a front casing piece made of a resin material that covers a front side of the circuit board and a back casing piece made of a resin material that covers a back side of the circuit board, wherein at least one of the front casing piece and the back casing piece of the card casing has a rear-end-face-forming wall portion that stands upright from a flat casing surface covering the circuit board and that defines the rear-end wall portion of the card casing, the rear-end-face-forming wall portion having at least one notch extending from an upright edge of the rear-end-face-forming wall portion toward a base thereof, wherein the anti-slipping member includes at least one support portion that extends into the card casing from an outside of the card casing through the at least one notch in the rear-end-face-forming wall portion and an internal latch portion provided on a part of the at least one support portion that is positioned inside the card casing, the internal latch portion being engaged with an inner surface of the rear-end-face-forming wall portion that faces the inside of the card casing so as to prevent the anti-slipping member from being detached, and wherein the front casing piece and the back casing piece are assembled together with the at least one support portion of the anti-slipping member being placed in the at least one notch and the internal latch portion being engaged with the inner surface of the rear-end-face-forming wall portion so that the anti-slipping member is anchored at the rear-end wall portion of the peripheral wall of the card casing, and wherein the upright edge of the rear-end-face-forming wall portion is in contact with the casing piece assembled thereto at a contact position, the front casing piece and the back casing piece being bonded together by ultrasonic welding at the contact position, the anti-slipping member including a main body that covers the rear-end wall portion of the card casing and portions extending from both ends of the main body along both side surfaces of the card casing, the extending portions partially covering both side surfaces of the card casing in areas near the rear-end wall portion, the anti-slipping member being formed of a material that is not welded by ultrasonic waves when the ultrasonic waves are applied to bond the front casing piece and the back casing piece together.

12. A card device comprising a circuit board and a card casing accommodating the circuit board, wherein the card device is configured to be inserted into and pulled out from a card slot in an apparatus in which the card device is to be mounted, and wherein an anti-slipping member is anchored at a rear-end wall portion of a peripheral wall of the card casing such that the anti-slipping member is exposed at a surface of a section of the card device at which the card device is held at least when the card device is inserted or pulled out, the rear-end wall portion being positioned at a rear end of the card device in an insertion direction in which the card device is inserted into the card slot, wherein the card casing includes a front casing piece that covers a front side of the circuit board and a back casing piece that covers a back side of the circuit board, wherein at least one of the front casing piece and the back casing piece of the card casing has a rear-end-face-forming wall portion that stands upright from a flat casing surface covering the circuit board and that defines the rear-end wall portion of the card casing, the rear-end-face-forming wall portion having at least one notch extending from an upright edge of the rear-end-face-forming wall portion toward a base thereof, wherein the anti-slipping member includes at least one support portion that extends into the card casing from an outside of the card casing through the at least one notch in the rear-end-face-forming wall portion and an internal latch portion provided on a part of the at least one support portion that is positioned inside the card casing, the internal latch portion being engaged with an inner surface of the rear-end-face-forming wall portion that faces the inside of the card casing so as to prevent the anti-slipping member from being detached, wherein the front casing piece and the back casing piece are assembled together with the at least one support portion of the anti-slipping member being placed in the at least one notch and the internal latch portion being engaged with the inner surface of the rear-end-face-forming wall portion so that the anti-slipping member is anchored at the rear-end wall portion of the peripheral wall of the card casing, and wherein the upright edge of the rear-end-face-forming wall portion is in contact with the casing piece assembled thereto at a contact position, the front casing piece and the back casing piece being bonded together at the contact position, wherein the front casing piece and the back casing piece are both made of a resin material and are bonded together by ultrasonic welding, wherein the anti-slipping member is formed of a material that is not welded by ultrasonic waves when the ultrasonic waves are applied to bond the front casing piece and the back casing piece together, and wherein portions of the front casing piece and of the back casing piece melted by the ultrasonic waves applied to bond the front casing piece and the back casing piece together flow into the at least one notch into toward the at least one support portion of the anti-slipping member and are cured to form a projection that projects from a wall surface of the at least one notch toward the at least one support portion so as to press a surface of the at least one support portion.

* * * * *